United States Patent [19]

Gustafson

[11] 4,274,072

[45] Jun. 16, 1981

[54] THERMOSTAT AND ASSEMBLY THEREFOR

[75] Inventor: Ralph W. Gustafson, Morrison, Ill.

[73] Assignee: General Electric Company, Fort Wayne, Ind.

[21] Appl. No.: 845,383

[22] Filed: Oct. 25, 1977

[51] Int. Cl.[3] ..... H01H 71/16

[52] U.S. Cl. ..... 337/75; 337/90; 337/359

[58] Field of Search ..... 337/71, 75, 90, 95, 337/344, 359, 362, 366; 335/205

[56] References Cited

U.S. PATENT DOCUMENTS

| | | | |
|---|---|---|---|
| 2,539,259 | 1/1951 | McCabe | 337/71 X |
| 3,222,474 | 12/1965 | Fasola, Jr. | 335/205 |
| 3,573,698 | 4/1971 | Witick | 337/103 |
| 3,656,082 | 4/1972 | Beck | 337/366 |

*Primary Examiner*—George Harris
*Attorney, Agent, or Firm*—Joseph E. Papin

[57] ABSTRACT

A thermostat for regulating the temperature of a space includes: means movable in the thermostat for sensing the temperature of the space; a switch device having means for switching between a pair of switching positions; and a pair of permanent magnet means for magnetic coupling relation with the switching means. Means is provided for translating the temperature sensing movement of the sensing means to the magnet means pair so as to attract the switching means from one of its switching positions to the other thereof. The translating means has a pair of means connected with each other for mounting the magnet means pair adjacent the switch device in the magnetic coupling relation with the switching means and also means for securing engagement with the sensing means so that the magnet means pair are conjointly movable with the sensing means and with respect to the switching device upon the temperature sensing movement of the sensing means to effect the attraction of the switching means from its one switching position to its other switching position.

An assembly for a thermostat is also disclosed.

50 Claims, 13 Drawing Figures

THERMOSTAT AND ASSEMBLY THEREFOR

FIELD OF THE INVENTION

This invention relates generally to temperature responsive devices and in particular to a thermostat and an assembly therefor.

Background of the Invention

In the past, various and sundry different type of thermostats have been employed for effecting regulation of the temperature of a space in which the thermostat may be located, and various different types of means have been employed in such thermostats for sensing the temperature of the space. For instance in some of the past thermostats which employed a temperature sensing means consisting of a bimetal element having a generally spiral configuration, such spiral bimetal element had a pair of inner and outer generally radially spaced ends, and the inner end was attached by suitable means to a post rotatably mounted on a base plate of the thermostat casing. The spiral bimetal element and the post were conjointly rotatable in response to the manual adjustment of a temperature selector to a set-point temperature desired for the space in which the thermostat was located. Thus, the spiral bimetal element was rotated to adjusted positions correlative to the set-point temperature indicated by the temperature selector in response to the manual movement thereof by an operator of the thermostat, and in respective ones of such adjusted positions correlative with the particular selected set-point temperature, the spiral bimetal element expanded or contracted in response to variations in the temperature with respect to such selected set-point temperature of the space in which the thermostat was located. In this manner, the temperature sensing movement, i.e. the aforementioned expansive or contractive movement, of the spiral bimetal element, was translated into or was operative to effect a switching operation of the thermostat. In other words, when the thermostat was in a selected one of its heating or cooling operating modes, the temperature sensing movement of the spiral bimetal element was effective to cause a switching operation so as to initiate or terminate the operation of a heating or cooling device conditioning the temperature of the space in which the thermostat was located.

Of course, this aforementioned switching operation of the thermostat in response to the temperature sensing movement of the spiral bimetal element was effected in various different manners. For instance, as illustrated in U.S. Pat. No. 3,993,120, either one or a pair of mercury switches were predeterminately positioned on a mounting bracket attached to the radially outer end of the spiral bimetal element so as to be conjointly movable with the spiral bimetal element in response to the temperature sensing movement thereof, and of course, such movement of the mercury switches affected the switching operation thereof so as to control the heating or cooling operating modes of the thermostat. In U.S. Pat. No. 3,656,082, a permanent magnet was attached to the radially outer end of the spiral bimetal element, and the temperature sensing movement of the spiral bimetal element conjointly moved the permanent magnet so as to operate a magnetically actuated reed-type switch associated therewith in order to control the heating or cooling operating modes of the thermostat.

In U.S. Pat. No. 2,539,259 a pair of pivotally movable magnets are respectively driven by the temperature sensing movements of a strip-type bimetal element so as to operate a pair of movable or magnetically actuated electrodes in a mercury switch associated therewith in order to control the heating or cooling operating modes of the thermostat.

In U.S. Pat. No. 3,573,698, one end of a generally U-shaped bimetal element is biased so that the temperature sensing movement of the other end of such bimetal element is correlative with the set-point temperature selected in order to effect the biasing of the one end of such bimetal element. The other end of the generally U-shaped bimetal element carries a pair of armatures respectively movable toward and away from magnetic coupling engagement with a permanent magnet associated therewith and encapsulated in a reed-type switch. The temperature sensing movement of the armature with the generally U-shaped bimetal element attracts the magnet within the reed-type switch between a pair of generally opposite switching positions to control the heating and cooling mode operations of the thermostat.

SUMMARY OF THE INVENTION

Among the several objects of the present invention may be noted the provision of an improved thermostat and an improved assembly for a thermostat; the provision of such improved thermostat and assembly in which magnetic symmetry is predetermined; the provision of such improved thermostat and assembly having a pair of magnets adapted to attract an armature in an encapsulated switch device and arranged to approach the armature generally at the same angles; the provision of such improved thermostat in which a switching device is adjustably assembled so as to be in a predetermined centered position with respect to another part of the thermostat; the provision of such improved thermostat and assembly in which a pair of magnet means are predeterminately disposed on carrying means therefor so as to be symmetrically arranged with means for mounting the carrying means to the thermostat as well as being adopted for symmetrical relation with an armature of a switch device of the thermostat; the provision of such improved thermostat and assembly in which the components thereof are simplistic in design, easily assembled, and economically manufactured. These as well as other objects and advantageous features of the present invention will be in part pointed out and in part apparent hereinafter.

In general, a thermostat is provided in one form of the invention for regulating the temperature of a space. Means is movable in the thermostat for sensing the temperature of the space, and a switch device has means for switching between a pair of switching positions. A pair of permanent magnet means is provided for magnetic coupling relation with the switching means, respectively, and means is provided for translating the temperature sensing movement of the sensing means to the magnet means pair so as to attract the switching means from one of its switching positions to the other thereof. The translating means includes: a pair of means connected with each other for mounting the magnet means pair adjacent the switch device in the magnetic coupling relation with the switching means; and means for securing engagement with the sensing means so that the magnet means pair are conjointly movable with the sensing means and with respect to the switching device upon the temperature sensing movement of the sensing means to effect the attraction of the switching means from its one switching position to its other switching position.

Also in general and in one form of the invention, a thermostat for regulating the temperature of a space is provided with a bimetal element having a spiral configuration with a generally radially outer end portion and movable in the thermostat for sensing the temperature of the space. A switch device has means encapsulated therein so as to be operable generally for switching between a pair of switching positions, and a pair of permanent magnet means exteriorly of the switch device in magnetic coupling relation with the switching means is adapted for movement with respect to the switching means so as to effect the switching operation of the switching means and attract it from one of its switching positions to the other thereof, respectively. Means associated with the magnet means pair is secured to said outer end portion of the bimetal element so as to be operable generally conjointly with the bimetal element for translating the temperature sensing movement thereof to the magnet means pair, the translating means being conjointly movable with the bimetal element upon the temperature sensing movement thereof so as to move the magnet means pair with respect to the switching means and effect the switching operation thereof from the one switching position to the other switching position.

Further in general and in one form of the invention, a thermostat has a base plate with an opening therein, and a shaft rotatably disposed about a centerline axis thereof extends at least in part into the opening in the base plate. A switch device includes means for switching between a pair of switching positions having an assembly position between the switching position pair, and means is provided for locating the switch device in a predetermined position on the base plate so that the switching means in its assembly position extends generally along a radius line emanating from the centerline axis of the shaft.

Also in general and in one form of the invention, an assembly adapted for effecting a switching operation in a thermostat has: a pair of magnets; means adapted for rotatably mounting the assembly to the thermostat; means for carrying said magnets in generally opposed spaced apart relation; and a bimetal element disposed between said mounting means and said carrying means and secured thereto, respectively.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting, in any manner, the scope of the invention or the disclosure thereof.

DETAILED DESCRIPTION OF THE PREFERRED EMBODIMENTS

Figure 1:
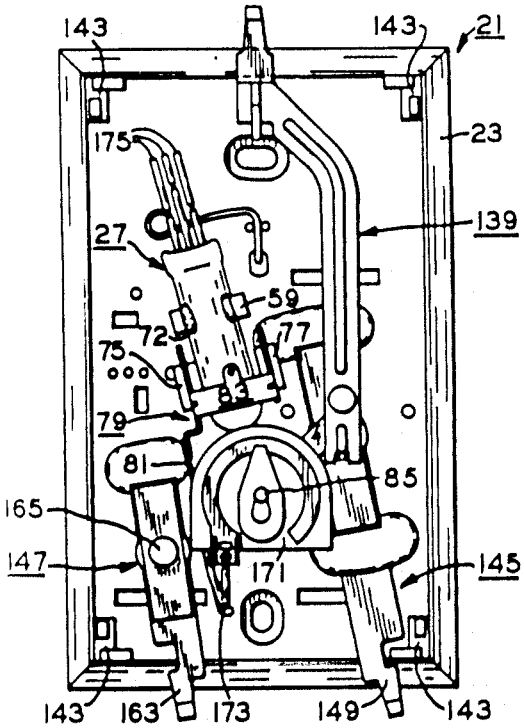
FIG. 1 is a plan view illustrating a thermostat in one form of the invention with a cover thereof removed for clarity and also illustrating principles which may be practiced in a method of assembling a thermostat.
Figure 2:
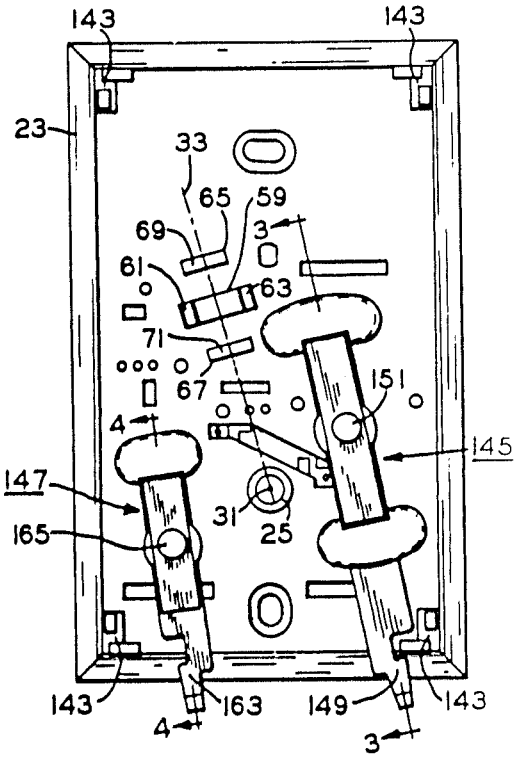
FIG. 2 is a plan view showing a base plate of the thermostat of FIG. 1 with a fan selector switch and a system selector switch mounted thereto.
Figure 5:
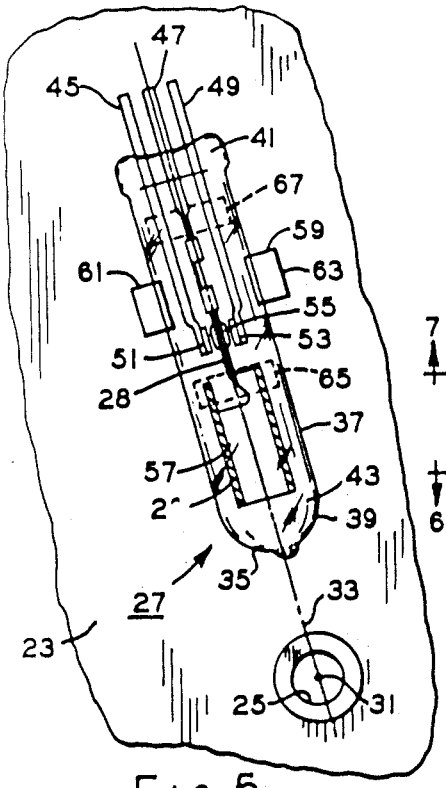
FIG. 5 is an enlarged fragmentary view taken from FIG. 1 with various components omitted for clarity and illustrating principles which may be practiced in a method of assembling a thermostat with a switch device thereof in a predetermined position on the base plate.

Referring now to the drawings in general, there is illustrated a method for assembling a thermostat 21 having a base or base plate 23 with an opening or shaft receiving bore 25 therein (FIGS. 1 and 2). Thermostat 21 is also provided with an encapsulated switch device 27 including switching means, such as a switch blade 28 and armature 29 for instance, adapted for switching operation therein between a pair of opposite switching positions with the switching means having an assembly or at-rest position spaced generally equidistantly between the switching position pair (FIGS. 1 and 5). In this method, encapsulated switch device 27 is arranged on base plate 23 so that switch blade 28 and armature 29 extend generally along a preselected radius line 31 emanating from a centerline axis 33 of opening 25 in the base plate (FIG. 5).

More particularly and with specific reference to FIG. 5, switch device 27 is constructed so that the component parts thereof are disposed generally in magnetic symmetry with respect to each other, as discussed hereinafter. Switch device 27 is provided with means, such as a generally elongate, cylindric, hollow tube or casing 35 formed of a non-magnetic material, such as glass for instance, for encapsulating at least in part the switching means, and a generally cylindric side wall 37 of the casing is interposed between a pair of opposite sealed ends or end walls 39, 41 thereof so as to define a sealed chamber 43 within the casing. While sidewall 37 of casing 35 is described and shown herein as being generally cylindric in one form of the invention, it is contemplated that the sidewall of the casing may be provided with other shapes or configurations so as to meet the objects and advantageous features of the invention. Three terminals 45, 47, 49 are predeterminately and sealably disposed generally in spaced side-by-side relation in end wall 41 of casing 35 so that the electrical connection sections of the three terminals extend exteriorly of the casing for connection in an electrical circuit (not shown) of the thermostat 21 with switch means supporting sections of the three terminals being disposed within casing chamber 43. A pair of opposed, predeterminately spaced apart contacts 51, 53 are carried on the supporting section of terminals 45, 49 within chamber 35, and these contacts, which define the aforementioned switching positions of switch blade 28 and armature 29 are each disposed within the chamber so as to be spaced generally equidistantly from sidewall 37 of casing 35. A double contact 55 is carried on switch blade 28 generally adjacent the end portion thereof for making and breaking engagement with contact pair 51, 53, respectively, and one end of switch blade 28 is mounted by suitable means, such as crimping, welding or soldering or the like, to the supporting section of terminal 47 while a generally elongate hollow cylinder or sleeve 57 formed of a magnetic or ferrous material is provided on the opposite end of switch blade and comprises the armature within chamber 35. It may be noted that the mass of armature 29 is generally small and that the armature is generally centered within casing 35 thereby to reduce or minimize contact bounce when the armature is magnetically attracted toward its switching positions, as discussed in greater detail hereinafter. With contact pair 51, 53 centered, i.e., disposed generally equidistantly from the sidewalls of the casing, it may be noted that in the at-rest position of switch blade 28 and armature 29, as shown in FIG. 5, double contact 55 thereof is spaced generally equidistantly between the contact pair, and the switch blade and armature are disposed or spaced generally equidistantly between the opposite sides of casing sidewall 37. In this manner, the pivotal travel of switch blade 28 and armature 29 generally about the supporting section of terminal 47 from the at-rest position of the switch blade and armature toward the opposite switching positons thereof so as to engage double contact 55 with contact pair 51, 53, respectively, is generally equal, and of course, such travel or displacement is effected upon the magnetic displacement of attraction of the armature, as discussed hereinafter. Thus, magnetic symmetry of armature 29 with respect to contact pair 51, 53 is provided.

As shown in FIGS. 2 and 5, means, such as a mounting bracket 59 or the like, is predeterminately disposed on base plate 23 of thermostat 21 with respect to opening 25 for mounting or otherwise supporting or positioning switch device 27 so that it is automatically located or positioned with respect to base plate 23, as discussed in greater detail hereinafter. Mounting means or mounting bracket 59 is connected by suitable means to base plate 23 and provided with a pair of generally resilient or movable tines or mounting fingers 61, 63 which are predeterminately spaced or disposed on opposite sides of radius line 33 emanating from centerline axis 31 of opening 25 in the base plate. While mounting bracket 59 is disclosed as being connected by suitable means to base plate 29, it is contemplated that the mounting bracket may be integrally formed with the base plate in one form of the invention so as to meet the objects and advantageous features thereof. A pair of means such as cradles or locating abutments 65, 67, are integrally formed with base plate 23 on opposite sides of mounting bracket 59 for locating switch device 27, and the cradles are provided with a pair of generally V-shaped locating surfaces 69, 71 which are also predeterminately aligned with radius line 33 emanating from centerline axis 31 of opening 25 in the base plate. While locating surfaces 69, 71 are described as being generally V-shaped in one form of the invention, it is contemplated that the locating surfaces may be provided with other shapes or configurations so as to meet the objects and advantageous features of the invention. In order to assemble or predeterminately locate switch device 27 with respect to thermostat 21, cylindric sidewall 37 of switch casing 35 is inserted or disposed between tines 61, 63 of mounting bracket 59, and the cylindric sidewall of the switch casing is also located on locating surfaces 69, 71 of locating means or cradles 65, 67. Since switch blade 28 and armature 29 in the at-rest position and contact pair 51, 53 are centered within casing 35 of switch device 27, as previously mentioned, the switch blade and armature are predeterminately or automatically positioned or disposed so as to extend generally along radius line 33 emanating from centerline axis 31 of opening 25 in base plate 23 when the casing is so located or disposed on locating surfaces 69, 71 of cradles 65, 67 between tines 61, 63 of mounting bracket 59. Thus, switch device 27 is predeterminately or automatically located on base plate 23 with respect to opening 25 therein so as to predetermine the magnetic symmetry of the switch device generally about radius line 33 emanating from centerline axis 33 of the opening. Subsequent to a certain adjusting movement of switch device 27 or cradles 65, 67 generally along radius line 33, as discussed in greater detail hereinafter, a hardenable material 72, such as an epoxy, a silicone rubber or other sealant or the like for instance (as best seen in FIG. 1), is disposed between tines 61, 63 of mounting bracket 59 and cylindric sidewall 37 of casing 35 and solidified in place so as to maintain the switch device against displacement movement.

Figure 6:
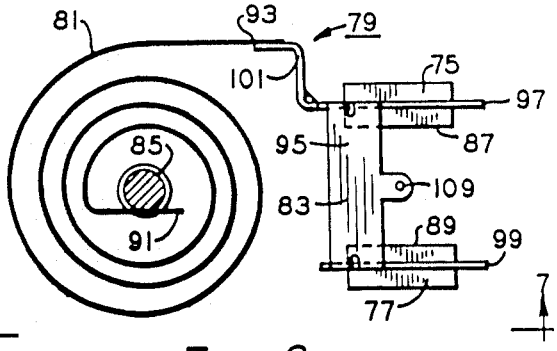
FIG. 6 is an enlarged fragmentary view taken from FIG. 1 showing the switch operation effecting means assembly in one form of the invention with an anticipator removed therefrom for clarity.
Figure 7:
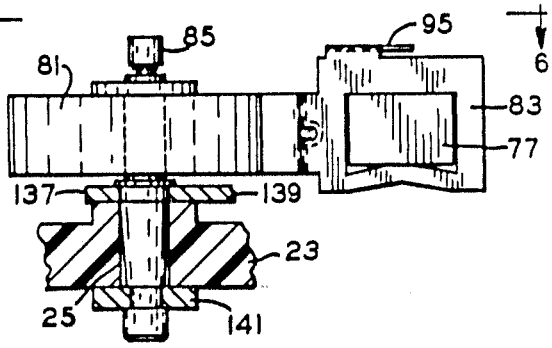
FIG. 7 is a side elevational view of the assembly of FIG. 6 illustrating the mounting thereof to the base plate.
Figure 10:
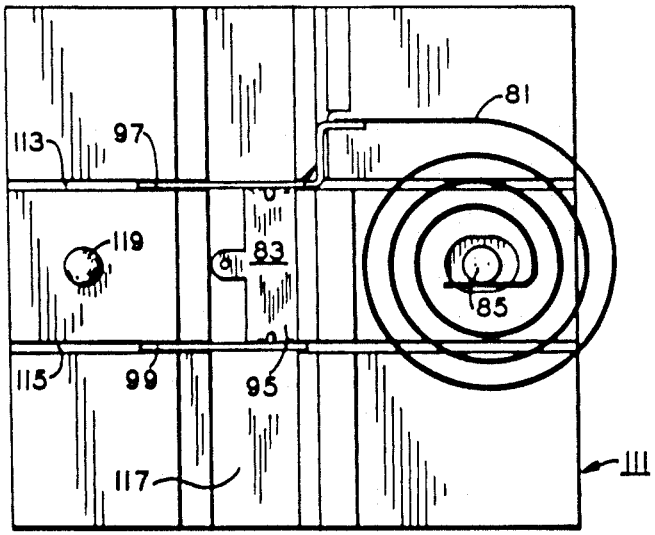
FIG. 10 is a plan view of a fixture showing the assembly of FIG. 6 disposed thereon and illustrating principles which may be practiced in a method of assembling the assembly.

With reference again to the drawings in general, another method is illustrated for assembling a pair of magnetic material elements 75, 77 in an assembly 79 having a bimetal element or bimetal means 81 secured between means, such as a bracket 83 or the like, for carrying the magnetic material elements, and means, such as a shaft or post 85 or the like, adapted for supporting or mounting the assembly (FIGS. 6 and 7). In this method, carrying means or carrying bracket 83 is disposed in a fixed position, and a free position of supporting means or shaft 85 is located with respect to the carrying bracket in its fixed position (FIG. 10). Magnetic material elements 75, 77 are then associated with carrying bracket 83 therefor, and a preselected section or opposed generally planar faces 87, 89 of each magnetic material element is arranged so as to be disposed generally in symmetrical relation which shaft 85 in the located free position thereof, respectively (FIG. 12).

Figure 8:
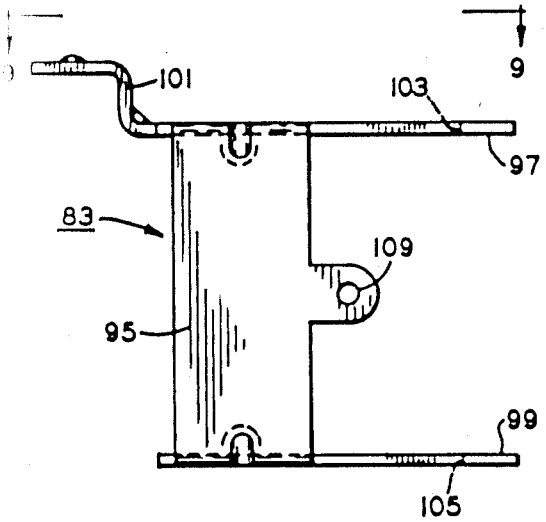
FIG. 8 is an enlarged isolated plan view of a magnet carrying means of the assembly shown in FIGS. 6 and 7.
Figure 9:
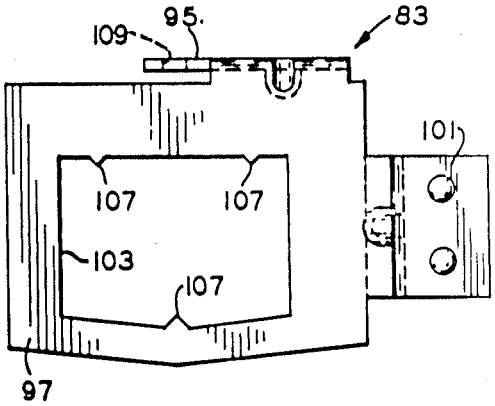
FIG. 9 is an elevational view of the carrying means in FIG. 8.

More particularly and with specific reference to FIGS. 6–9, magnetic material elements 75, 77 may be Plastiform permanent magnets available from the 3M Company, 3M Center, St. Paul, Minn. and while the magnetic material elements are shown generally in the shape of a rectangular block, it is contemplated not only that other types of magnets may be employed but also that other shapes may be utilized within the scope of the invention so as to meet the objects thereof. Bimetal element 81 of assembly 79 is provided with a generally spiral configuration, and the bimetal element has a pair of ends or end portions 91, 93 disposed generally in radially spaced relation with respect to each other, as best seen in FIG. 6. Radially inner end portion 91 of generally spiral bimetal element 81 is attached by suitable means, such as soldering for instance, to shaft 85, and radially outer end portion 93 of the bimetal element is attached by suitable means such as soldering, welding or crimping for instance, with carrying bracket 83. As best seen in FIGS. 8 and 9, carrying bracket 83, which is formed of a non-ferrous material, is provided with a cross piece or arm 95 having a pair of integral oppositely spaced arms or flanges 97, 99 respectively depending therefrom, and one of the depending arms 97 is provided with an integral tab 101 which is connected to radially outer end portion 93 of bimetal element 81, as previously discussed. Depending arms 97, 99 of carrying bracket 83 are provided with a pair of openings 103, 105 adapted to receive magnetic material elements 75, 77, respectively, and a plurality of barbs 107 or the like (as best seen in FIG. 9) are integrally formed on the arms adjacent the upper and lower marginal edges of the openings for gripping engagement with the magnetic material elements when they are received in the openings, as discussed hereinafter. It may be noted that a locating or reference point, such as an aperture 109 in cross piece 97 of carrying bracket 83 is spaced or disposed a preselected distance from the centerline axis of shaft 85 when tab 101 of the carrying bracket is attached or otherwise secured to radially outer end 93 of bimetal element 81, as previously described. Although bimetal element 81 is shown having a generally spiral shape, it is contemplated that a bimetal element shaped other than generally spirally may be utilized in one form of the invention so as to meet the objects thereof.

Figure 12:
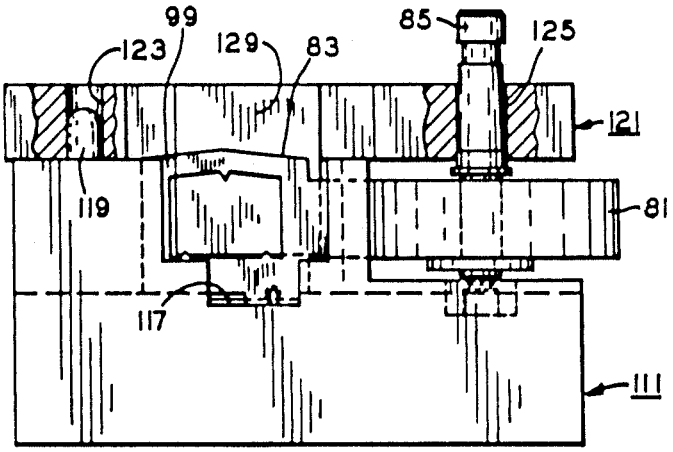
FIG. 12 is an elevational view of the fixture and assembly of FIG. 9 showing the fixture of FIG. 11 associated therewith so as to locate the free position of a shaft of the assembly.
Figure 11:
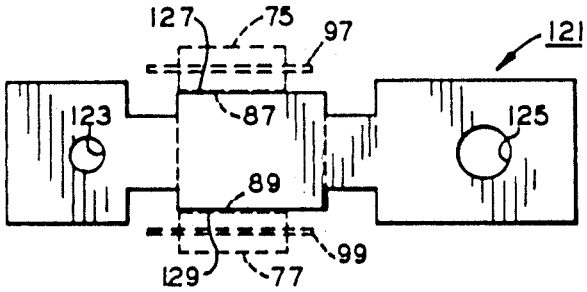
FIG. 11 is a plan view of another fixture adapted for association with the fixture of FIG. 10.

An assembling fixture 111, FIGS. 10 and 12, may be formed, if desired, from either a ferrous or non-ferrous material, and is provided with a pair of predeterminately spaced apart means, such as grooves 113, 115 which are sized for locating or receiving engagement with arms 97, 99 of carrying bracket 83. Groove pair 113, 115 are intersected by means, such as a cross-groove 117, sized for locating or receiving engagement with cross-piece 95 of the carrying bracket. Cross-groove 117 extends generally perpendicular to groove 113, 115 intersecting therewith, and a pivoting post 119 is integrally provided on assembling fixture 111 so as to be spaced generally equidistantly between groove pair 113, 115. As shown in FIGS. 11 and 12, another assembling fixture or centering block 121 is formed from either a ferrous material or a non-ferrous material, such as a plastic or the like for instance. Centering block 121 is provided with a pair of predeterminately spaced apart pivot pin receiving and shaft locating apertures or openings 123, 125 therethrough adjacent the opposite ends of the centering block and a pair of depending opposite centering or locating surfaces or faces 127, 129 which are generally planar are provided on the centering block intermediate the apertures thereof. Centering surfaces 127, 129 are predeterminately arranged with opening 125 in centering block 121 so as to extend in planes which are generally symmetrical with respect to or about shaft locating opening 125.

In order to locate carrying bracket 83 of assembly 79 in its fixed position, as previously mentioned, depending arms 97, 99 of the carrying bracket are disposed or inserted generally edge-wise into the spaced apart groove pair 113, 115 of assembling fixture 111, and cross piece 95 of the carrying bracket is disposed or inserted into cross groove 117 of the assembling fixture. It may be noticed that the locating or positioning abutment or engagement of depending arms 97, 99 of carrying bracket 83 within groove pair 113, 115 and that of cross piece 95 within cross groove 117 generally obviates displacement movement of the carrying bracket when it is so mounted in its fixed position on assembling fixture 111. With carrying bracket 83 so disposed in its fixed positon, it may be noted that bimetal element 81 and shaft 85 attached thereto are free and may move so as to ascertain the free position of the shaft with respect to the carrying bracket located in its fixed position on assembling fixture 111. Thus, with carrying bracket 83 in its fixed position and shaft 85 in its free position, centering block 121 is assembled with assembling fixture 111 and assembly 79 so that aperture 123 in the centering block is disposed in locating engagement about pivot pin 119 of the assembling fixture with locating aperture 125 in the centering block disposed over or generally about shaft 85 in its free position thereby to positively locate the free position of the shaft with respect to carrying bracket 83 in its fixed position. With centering block 121 so mounted with assembling fixture pivot pin 119 and shaft 85 of assembly 79, it may be noted that centering surfaces 127, 129 on the centering block are also predeterminately located so as to extend in the planes which are now symmetrical not only with respect to locating aperture 125 in the centering block, as previously mentioned, but also with respect to the shaft 85 in its located free position disposed within the locating aperture. At this time, magnetic material elements 75, 77 may be inserted into predetermined or located positions through openings 103, 105 in depending arms 97, 99 of carrying bracket 83 so that opposed faces 87, 89 of the magnetic material elements may be moved into generally planar abutting engagements with centering surfaces 127, 129 on centering block 121. With opposed faces 87, 89 of magnetic material elements 75, 77 so disposed in the generally planar abutting engagement with centering surfaces 127, 129 of centering block 121, it may be noted that the opposed faces of the magnetic material elements are now also predeterminately positioned or located to generally extend in the planes of the centering surfaces of the centering block thereby to be arranged generally symmetrically with respect to shaft 85 in its located free position. If desired, a slight holding force may be applied generally simultaneously onto magnetic material elements 75, 77 to hold them against surfaces 127, 129 so as to create or establish the desired magnet air gap. At this time, a tool (not shown) may be brought into engagement with each of arms 97, 99 of carrying bracket 83 so as to stake or otherwise deform the arms into holding or gripping engagement with magnetic material elements 75, 77, and barbs 107 are, of course, driven into the side edges of the magnetic material elements.

Figure 13:
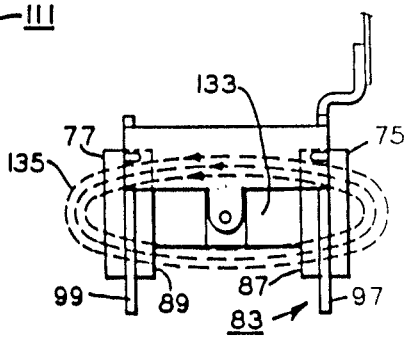
FIG. 13 is a fragmentary view illustrating the assembly of FIG. 6 located therein for magnetizing the magnetic material elements of the assembly.

With magnet material elements 75, 77 so fixed in their predetermined positions within openings 103, 105 of carrying bracket 83, as described above, assembly 79 may now be transferred to an electrical charging or magnetizing device (not shown). Carrying bracket 83 may be disposed in a charging fixture of the aforementioned electrical charging or magnetizing device with a charging bar 133 thereof arranged in abutting engagement between opposing faces 87, 89 of magnetic material elements 75, 77 generally midway thereof, as shown in FIG. 13, and an electrical current is then applied to the charging bar in order to magnetize the magnetic material elements. The electrical charging device for effecting the magnetization of magnetic material elements 75, 77 may be a Magnet Charger Model 1500 available from RFL Industries, Inc., Boonton, N.J. As illustrated in FIG. 13, magnetic flux lines, shown schematically at 135, effected upon the electrical charging of charging bar 133 are predetermined so that opposite ones of opposed faces 87, 89 of magnetic material elements 75, 77 are magnetized as north and south poles depending upon the direction of the flux lines entering and leaving the magnetic material elements.

In an alternative method of assembling assembly 79, assume that magnetic material elements 75, 77 are magnetized so as to be actual magnets prior to the assembly thereof within openings 103, 105 of carrying bracket 83 when assembly 79 is positioned with respect to assembling fixture 111 and centering block 121 as previously described. In this alternative method, centering block 121 or at least the opposite surfaces 127, 129 thereof are formed of a ferrous material. Thus, when magnets 75, 77 are moved or inserted through openings 103, 105 in arms 97, 99 of carrying bracket 83 toward opposed surfaces 127, 129 of centering block 121, opposing faces 87, 89 of the magnets are attracted into magnetic holding engagement with the surfaces of the centering block, and upon such magnetic engagement, the opposed faces of the magnets are predeterminately positioned or located to generally extend in the planes of the centering surfaces thereby to be arranged generally symmetrically with respect to the shaft 85 in its located free position. Thereafter, arms 97, 99 of carrying bracket 83 may be deformed into retaining engagement with magnets 75, 77 in their predetermined positions in the same manner as previously described hereinabove.

Subsequent to the magnetizing of magnetic material elements 75, 77 mounted to carrying bracket 83 therefor in the predetermined symmetrical relation with respect to shaft 85 of assembly 79, as described above, a bifurcated end 137 of a temperature selector, such as a lever 139 or the like, is inserted or disposed in gripping engagement with the shaft, and the assembly and temperature selector is mounted on base plate 23 of thermostat 21 in order to dispose the assembly in magnetic symmetry with switch device 27, as best seen in FIGS. 1 and 7. In the assembling of assembly 79 to base plate 23 of thermostat 21, shaft 85 is inserted into rotatable or pivotal engagement within opening 25 in the base plate so that magnets 75, 77 are disposed in straddling relation with respect to switch device 27, i.e. on opposite sides of casing 37 thereof. At this time, means, such as a spring clip or retainer 141 or the like, for retaining shaft 85 against displacement from opening 25 in base plate 23 is inserted or otherwise disposed in engagement between the lower end of the shaft and the base plate generally about the opening therein, as best seen in FIG. 7. Thereafter, calibration of assembly 79 may be effected in a preselected temperature environment. In calibrating assembly 79, shaft 85 may be held or otherwise fixed by suitable means (not shown) against further rotation in opening 25 of base plate 23, and temperature selector 139 is pivoted or rotated about the shaft to a position correlative with or indicative of the environmental preselected temperature. Since armature 29 of switch device 27 extends generally along radius line 31 emanating from centerline axis 33 of opening 25 in base plate 23 of thermostat 21 and opposed faces 87, 89 of magnetic material elements 75, 77 are arranged so as to be generally symmetrical with shaft 85 in its free position, as rotatably disposed in the opening, it may be noted that the faces of the magnetic material elements are pivotally movable about the shaft so as to approach sidewall 37 on casing 35 of the switch device at generally the same angles, as discussed hereinafter, thereby to predetermine the magnetic symmetry of assembly 79 with respect to the switch device, as best seen in FIG. 1. Of course, when magnetic material element 75 is so disposed in engagement with casing sidewall 37 of switch device 27, the magnetic material element attracts armature 29 toward it. Thus, armature 29 is displaced from its at-rest position extending generally along radius line 33 to one of the aformentioned switching positions engaging double contact 55 on switch blade 28 with contact 51 carried by terminal 45. Either prior or subsequent to the calibration of assembly 79 when rotatably mounted to base plate 23 of thermostat 21, as discussed above, switch device 27 may be adjustably moved on cradles 65, 67 toward or away from opening 25 and with respect to magnetic material elements 75, 77 so as to predetermine the force of the magnetic attraction or coupling relation between armature 29 of the switch device and the magnetic material elements. Thereafter, sealant 72 is applied to casing 35 of switch device 27 and mounting bracket 59 therefor, as previously discussed, and it should be noted that such adjusting movement of the switch device on cradles 65, 67 does not affect the predetermined symmetry or alignment of the switch device with respect to centerline axis 33 of opening 25, as previously discussed.

With reference again to the drawings in general and recapitulating at least in part with respect to the foregoing, assembly 79 is illustrated in one form of the invention so as to be adapted for effecting a switching operation in thermostat 21. Assembly 79 includes a pair of magnets, such as the magnetic material elements 75, 77, and means, such as shaft 85, adapted for rotatably mounting or supporting the assembly with respect to thermostat 21 (FIGS. 1 and 6). Further movable means or movement effecting, means, such as carrying bracket 83, is provided for carrying magnets 75, 77 in generally opposed spaced apart relation, and bimetal element 81 is disposed between the mounting or supporting means or shaft 85 and the carrying means or carrying bracket 83 and is secured thereto, respectively (FIGS. 6 and 7).

Still further with respect to the drawings in general and again recapitulating at least in part with respect to the foregoing, thermostat 21 (FIG. 1) in one form of the invention is provided for regulating the temperature of a space (not shown) in which the thermostat may be located. In thermostat 21, means, such as bimetal element 81, is movable on the thermostat for sensing the temperature of the space, and switch device 27 has means therein, such as switch blade 28 and armature 29, for switching between a pair of switching positions (FIG. 5). A pair of permanent magnet means, such as the magnet material elements 75, 77, is provided for magnetic coupling relation with the switching means respectively, and means, such as carrying bracket 83, is provided for translating the temperature sensing movement of the sensing means or bimetal element 81 to the magnet means pair or magnetic material elements so as to attract the switching means from one of its switching positions to the other thereof, as previously discussed (FIGS. 1, 5 and 6). Translating means or carrying bracket 83 includes a pair of means, such as depending arms 103, 105, connected with each other for mounting magnetic material elements 75, 77 adjacent switch device 27 in the magnetic coupling relation with armature 29 thereof, and means, such as tab 101, extends from at least one of the mounting means of depending arms 103, 105 for securing engagement with bimetal element 81 so that the magnetic material elements are conjointly movable with the bimetal element and with respect to switch device 27 upon the temperature sensing movement of the bimetal element to effect the attraction of armature 29 and move the switching means from its one switching position to its other switching position (FIGS. 1 and 5-9).

Figure 3:
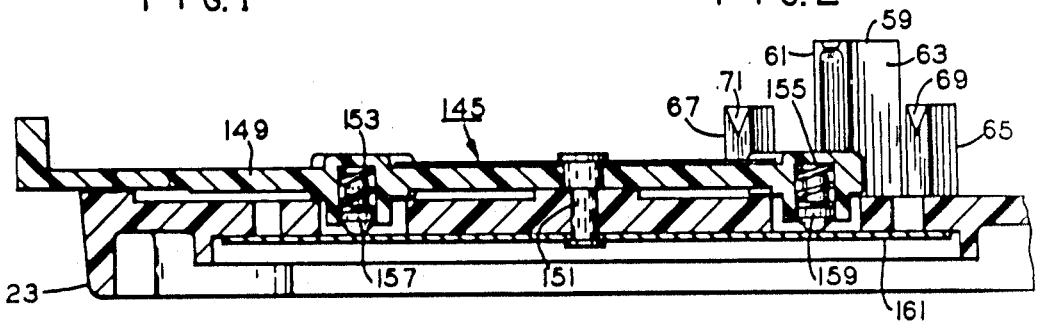
FIGS. 3 and 4 are sectional views taken along lines 3—3 and 4—4 of FIG. 2, respectively.
Figure 4:
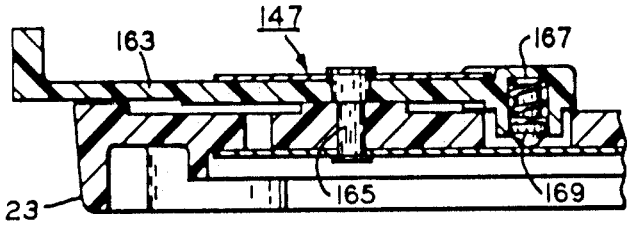

More particularly and with specific reference to FIGS. 1-4, base plate 23 of thermostat 21 is provided with means, such as a plurality of split posts 143 or the like respectively at each corner of the base plate, for releasable securing engagement with a cover (not shown) for the thermostat, and such cover may contain temperature setting indicia appropriately positioned with respect to temperature selector 139 as well as other indicia concerning the settings of both a system or mode selector switch and a fan switch, indicated generally at 145, 147, respectively, of the thermostat. System selector switch 145 (as best seen in FIG. 3) has a generally flat elongate lever 149 which is pivotally or rotatably mounted on a pivot post or pin 151 secured to base plate 23, and the lever is provided with a pair of spaced apart recesses 153, 155 which house a pair of spring loaded, indexing type contacts 157, 159, respectively. Contacts 157, 159 of system selector switch are resiliently urged toward electrical contacting engagement with a stamped-out metallic circuit board or plate, indicated generally at 161. Of course, lever 149 of system selector switch 145 is manually pivotally movable about pivot pin 151 between three operating positions, i.e. "off", "heat", and "cool" positions, so as to select the desired operating mode of thermostat 21, and upon such pivotal movement of the lever, contacts 157, 159 are respectively resiliently urged or indexed into electrical contacting engagement between various stamped-out parts (not shown) of circuit plate 161 to effect the heating or cooling mode operations of the thermostat or to turn off the thermostat. As best seen in FIG. 4, fan switch 47 also is provided with a generally flat elongate lever 163 which is pivotally or rotatably mounted on a pivot post or pin 165 secured to base plate 23, and a recess 167 is provided in the lever generally adjacent an end thereof. Another spring loaded, indexing type contact 169 is housed in recess 167 of lever 163 and is resiliently urged toward electrical contacting engagement with circuit plate 161. Of course, lever 163 of fan switch 147 is manually pivotally movable about pivot pin 165 between an "on" position and an "automatic" position so as to select the desired operation of a fan or blower (not shown) during the heating or cooling mode operation of thermostat 21. Upon the pivotal movement of lever 163, contact 169 is resiliently urged or indexed into electrical contacting engagement between various stamped-out parts (not shown) of circuit plate 161 to effect the aforementioned desired operation or mode of the fan. Although system selector switch 145, fan switch 147 and circuit plate 161 are described hereinabove in one form of the invention, it is contemplated that other types of forms of system selector switches, fan switches and circuitry may be utilized in thermostat 21 so as to meet the objects and advantageous features thereof. Further, while circuit plate 161 is illustrated as secured by pivot pins 151, 165 to base plate 23 of thermostat 21, it is contemplated that other means for securing the circuit plate to the base plate may also be utilized within the scope of the invention so as to meet the objects thereof. Further, if a more detailed discussion of the circuitry included in circuit plate 161 is desired, reference may be had to the thermostat circuitry disclosed in the Wiley M. Hummel U.S. Pat. No. 4,016,520 issued Apr. 5, 1977 which is incorporated herein by reference.

As shown in FIG. 1, a heat anticipator assembly 171 is secured to the upper end of shaft 85 so as to extend generally adjacent and over bimetal element 81 secured to the shaft, as discussed in detail hereinabove. Heat anticipator assembly 171 is connected by a lead 173 in circuit relation with circuit plate 161, and when energized, the heat anticipator assembly is operable to transmit anticipation heat directly to bimetal element 81 so as to prevent temperature overshoot or undershoot, as is well known in the art. To complete the description of thermostat 21, a plurality of leads 175 are respectively connected in circuit relation between terminals 45, 47, 49 of switch device 27 and circuit plate 161 so that the switching operation of the switch device is effective when system selector switch is disposed in one of its heating or cooling operating mode positions. If a more detailed discussion of the function of a heat anticipator, such as heat anticipator assembly 171, in a thermostat is desired, reference may be had to the copending Dann W. Denny application Ser. No. 750,280 filed Dec. 13, 1976, now U.S. Pat. No. 4,114,681 which is incorporated herein by reference.

If an operator desires to effect the heating mode operation of thermostat 21 so as to effect heating of the space in which the thermostat may be located, lever 149 of system selector switch 145 is manually pivoted about pivot pin 151 so as to index contacts 157, 159 into positions in electrical contacting engagement with circuit plate 161 effecting the "heat" mode position of the system selector switch and the heating mode operation of thermostat 21, FIGS. 1 and 3. Of course, lever 163 of fan switch 147 may also be manually pivoted about pivot pin 165 so as to index contact 169 into a position in electrical contacting engagement with circuit plate 161 effecting a desired one of the "on" or "automatic" position of the fan switch, as desired, FIGS. 1 and 4. With system selector switch 145 and fan switch 147 so disposed in the desired positions thereof, as discussed above, the operator may now select a set-point temperature desired for the space in which thermostat 21 is located by exerting an applied force on temperature selector 139 so as to rotate it in a generally clockwise direction, as best seen in FIG. 1, toward the desired or selected temperature setting thereof, say 70° F. for instance. The operator applied force movement or rotation of temperature selector 139 effects the conjoint rotation therewith of shaft 85 within opening 25 of base plate 23, FIG. 7, and since bimetal element 81 is carried on shaft 85, the bimetal element is conjointly rotatable therewith to an adjusted position correlative with the set-point temperature indicated by temperature selector 139. Of course, this conjoint rotation of bimetal element 81 with shaft 85 is translated by carrying bracket 83 into conjoint pivotal movement or rotation of magnets 75, 77 about the shaft. Thus, as the torque of bimetal element 81 exceeds the magnetic attraction between armature 29 and magnet 77, the magnets 75, 77 are rotated generally in a clockwise direction about shaft 85 with snap action; therefore, magnet 77 is positioned farther away from armature 29 of switch device 27 so as to decrease the magnitude of the magnetic coupling or attraction force therebetween. When the magnitude of the magnetic attraction force between armature 29 and magnet 75 exceeds that between the armature and magnet 77, the armature will move or snap in a direction toward magnet 75 so as to break double contact 55 from contact 53 and make the double contact with contact 51, FIGS. 1 and 5. Thus, as shown in FIG. 1, in the aforementioned adjusted position of bimetal element 81, magnet 75 is disposed in abutment with sidewall 37 casing 35 of switch device 27, and armature 29 is attracted in magnetic coupling relation toward magnet 75 so as to make double contact 55 on the armature with contact 51 of the switch device. When double contact 55 is engaged with contact 51, a heating system (not shown) is enabled or energized for conditioning the air of the space in which thermostat 21 is located since system selector switch 145 is in its heat mode position, as previously mentioned.

Of course, bimetal element 81 is also movable in its adjusted position with respect to shaft 85 so as to generally wind and unwind in the clockwise and counterclockwise directions thereabout, respectively, in response to the particular temperature of the space sensed by the bimetal element. With the temperature of the space being increased or heated upon the enablement of the heating system and/or anticipator 171, bimetal element 81 expands creating a force tending to move or rotate its radially outer end 93 generally in the counterclockwise direction with respect to shaft 85. This increasing torque on bimetal element outer end 93 conjointly pivotally urges carrying bracket 83 and magnets 75, 77 in the counterclockwise direction with respect to shaft 85. Thus, as the temperature of the space is increased to the selected temperature of 70° F., the magnitude of the expansive force of bimetal element 81 exceeds that of the attraction force between magnet 75 and armature 29 so that assembly 79 will move its magnets 75, 77 with snap action in the counter-clockwise direction about shaft 85 toward a position in which magnet 77 is disposed in engagement with sidewall 37 on casing 35 of switch device 27. Thus, upon this temperature sensing rotation of bimetal element 81 in its adjusted position, armature 29 is attracted in magnetic coupling relation toward magnet 77 so as to make double contact 55 on switch blade 28 with contact 53 of the switch device since the attraction force between the armature and magnet 77 is now greater than that between the armature and magnet 75. When double contact 55 is so engaged with contact 53, the heating system is disabled or deenergized as well as heat anticipator assembly 171.

With the heating system so deenergized, the temperature of the conditioned air in the space in which thermostat 21 may be located, of course, falls, and at a preselected differential in excess of the selected temperature setting, bimetal element 81 will contract to a degree creating a contractive force to effect the return conjoint rotation with snap action of carrying bracket 83 and magnets 75, 77 to their respective adjusted positions, as previously mentioned, thereby to re-energize the heating system to again increase the temperature of the conditioned air in the space to the selected temperature of 70° F. Upon the return rotation of magnets 75, 77 to the adjusted position of bimetal 81, as previously discussed, armature 29 is attracted in magnetic coupling relation toward magnet 75 so as to disengage double contact 55 from contact 53 and remake the double contact with contact 51 of switch device 27. Of course, this operation of assembly 79 to effect the switching operation of switch device 27, as previously discussed, in order to control the heating system may be cyclically or periodically repeated in response to the temperature demands of the space in which thermostat 21 is located so as to generally maintain the selected temperature of the space.

Further, if the operator desires to effect the cooling operating mode of thermostat 21, system selector switch 145 is manually rotated from its "heat" position to its "cool" position so as to enable or energize a cooling system for conditioning the air of the space in which thermostat 21 is located, and the component parts of the thermostat function in the same manner as previously described in order to control the operation of the cooling system in response to the temperature demands of the space so as to generally maintain the selected temperature of the space.

From the foregoing, it is now apparent that a novel thermostat 21 is presented meeting the objects and advantageous features set out hereinbefore, as well as others, and that changes as to the precise arrangements, shapes, connections and details of the constructions illustrated herein by way of example for purposes of disclosure may be made by those having ordinary skill in the art without departing from the spirit of the invention or the scope thereof as defined by the claims which follow.

What I claim as new and desire to secure by Letters Patent of the United States is:

1. A thermostat adapted for effecting regulation of the temperature of a space in which the thermostat may be located, the thermostat comprising:

a casing including a base;

a post rotatably mounted to said base;

bimetal means adapted for movement to adjusted positions and movable in respective ones of the adjusted positions for sensing the temperature of the space, said bimetal means having a generally spiral configuration with generally radially spaced inner and outer ends and said inner end being secured to said post so as to be conjointly rotatable therewith;

a temperature selector manually movable with respect to said casing within a predetermined range of temperature settings so as to set a preselected temperature for the space and operably connected with said post to conjointly rotate said post and said bimetal means to a respective one of the adjusted positions of said bimetal means correlative with the preselected temperature set by said temperature selector upon the manual movement thereof;

a switch device including a pair of spaced apart terminals, a first pair of contacts mounted in opposed relation on said terminal pair, a third terminal disposed between said terminal pair and including a movable armature, a second pair of contacts mounted to said armature for making engagement with and breaking disengagement from said first contact pair, and means for encapsulating said switch device with parts of said terminal pair and said third terminal disposed exteriorly of said encapsulating means so as to define circuit connection sections, respectively;

means secured to said base and embracing at least in part said encapsulating means for mounting said switch device in a predetermined position with respect to said post;

a bracket associated with said bimetal means so as to be conjointly movable therewith and including a pair of arms disposed generally adjacent said encapsulating means and on opposite sides of said terminal pair therein, respectively, means extending generally across said encapsulating means for integrally interconnecting said arm pair, and means on said bracket for securing engagement with said outer end of said bimetal means; and a pair of magnet means mounted on said arm pair and adapted for magnetic coupling relation with said armature, respectively, said magnet means pair being conjointly movable generally in one direction and another direction opposite thereto toward and away from said terminal pair so as to attract said armature in one of the one and another directions and effect the circuit completing engagement of one of said contacts of said second contact pair with one of said contacts of said first contact pair upon the conjoint movement of said bracket with said bimetal means in response to the temperature sensing movement of said bimetal means in the respective one of its adjusted positions.

2. A thermostat for regulating the temperature of a space comprising:

means movable in the thermostat for sensing the temperature of the space;

a switch device having means for switching between a pair of switching positions;

a pair of permanent magnet means for magnetic coupling relation with said switching means, respectively; and means for translating the temperature sensing movement of said sensing means to said magnet means pair so as to attract said switching means from one of its switching positions to the other thereof, said translating means including a pair of means connected with each other for mounting said magnet means pair adjacent said switch device in the magnetic coupling relation with said switching means, and means for securing engagement with said sensing means so that said magnet means pair are conjointly movable with said sensing means and with respect to said switch device upon the temperature sensing movement of said sensing means to effect the attraction of said switching means from its one switching position to its other switching position.

3. A thermostat as set forth in claim 2 wherein said sensing means comprises a bimetal element having a generally spiral configuration with a pair of radially spaced apart end portions, one of said end portions being secured in engagement with said securing means.

4. A thermostat as set forth in claim 2 wherein said translating means further includes a pair of openings in said mounting means and disposed in embracing engagement with said magnet means pair, respectively.

5. A thermostat as set forth in claim 2 wherein said translating means further includes means for interconnecting said mounting means.

6. A thermostat as set forth in claim 2 further comprising means drivingly associated with said sensing means and movable generally for setting a selected temperature of the space, said setting means being movable in response to an applied force thereon to a set point of the selected temperature and to conjointly drive said sensing means to an adjusted position correlative with the selected temperature in which said sensing means is responsive to sense the selected temperature.

7. A thermostat for regulating the temperature of a space comprising:

a bimetal element having a spiral configuration with a generally radially outer end portion and movable in the thermostat for sensing the temperature of the space;

a switch device having means operable generally for switching between a pair of switching positions;

a pair of permanent magnet means in magnetic coupling relation with said switching means and adapted for movement with respect to said switching means so as to effect the switching operation of said switching means and attract it from one of its switching positions to the other thereof, respectively; and means associated with said magnet means pair and secured to said outer end portion of said bimetal element so as to be operable generally conjointly with said bimetal element for translating the temperature sensing movement thereof to said magnet means pair, said translating means being conjointly movable with said bimetal element upon the temperature sensing movement thereof so as to move said magnet means pair with respect to said switching means and effect the switching operation thereof.

8. A thermostat as set forth in claim 7 wherein said switching means comprises a pair of spaced apart terminals having a pair of contacts thereon respectively defining the one and other switching positions, and a third terminal movably disposed between said terminal pair so as to be respectively engaged therewith.

9. A thermostat as set forth in claim 7 wherein said bimetal element is mounted to a rotatable post in the thermostat.

10. A thermostat as set forth in claim 7 wherein said translating means includes means for mounting said magnet means pair so as to be generally symmetrical with respect to said switch device as said magnet means pair are moved with respect thereto in order to effect the switching operation of said switching means.

11. A thermostat as set forth in claim 7 wherein said translating means comprises a pair of spaced apart means for respectively mounting said magnet means pair, means for interconnecting said mounting means, and means for securing engagement with said outer end portion of said bimetal element.

12. A thermostat as set forth in claim 7 further comprising means for rotatably mounting said bimetal element on the thermostat so that said bimetal is movable to a plurality of adjusted positions and operable generally in a respective one of the adjusted positions so as to sense the temperature of the space.

13. A thermostat as set forth in claim 12 further comprising means associated with said rotatably mounting means and pivotally movable for setting a selected temperature of the space, said setting means being pivotally movable in response to an applied force thereon toward a set point of the selected temperature and so as to effect generally conjoint rotation therewith of said rotatable mounting means in order to dispose said bimetal element in the respective one adjusted position thereof correlative with the selected temperature.

14. A thermostat having a cooling mode operation and a heating mode operation so as to regulate the temperature of a space in which the thermostat may be located, the thermostat comprising:

means operable generally for selecting the cooling mode operation and the heating mode operation of the thermostat;

means movable in the thermostat to adjusted positions and operable in respective ones of the adjusted positions for sensing the temperature of the space in both the cooling and heating operating modes of the thermostat;

means for rotatably mounting said sensing means to the thermostat;

means drivingly associated with said rotatably mounting means and pivotally movable for setting a selected temperature of the space in both the cooling and heating mode operation of the thermostat, said setting means being pivotally movable in response to an applied force thereon toward a set point of the selected temperature so as to rotatably drive said rotatably mounting means and dispose said sensing means in the respective one adjusted position thereof correlative with the selected temperature;

a switch device including means operable generally for switching between a pair of opposite switching positions so as to control the cooling and heating mode operations of the thermostat with said switching means having an at-rest position spaced generally equidistantly between the switching positions;

a pair of permanent magnet means arranged generally symmetrically with respect to said switch device in magnetic coupling relation with said switching means and adapted for movement with respect to said switching means so as to magnetically effect the switching operation thereof to one of the switching positions and the other of the switching positions, respectively;

means for adjustably mounting said switching device to the thermostat so that said switching means in its atrest position extends generally along a radius of the rotatably mounting means; and means associated with said magnet means pair so as to mount them and secured to said sensing so as to be movable generally conjointly therewith for translating the temperature sensing movement of said sensing means into the movement of the magnet means pair with respect to said switch device in order to effect the magnetic switching operation of said switching means.

15. An assembly adapted for effecting a switching operation in a thermostat comprising:

a pair of magnets;

means adapted for rotatably mounting the assembly to the thermostat;

movable means for carrying said magnets generally in opposed and predetermined spaced apart relation so that said magnets are conjointly movable with said movable means; and a bimetal element secured to said mounting means and to said movable means and adapted for operation to effect the conjoint movement of said movable means and said magnets carried in the opposed and predetermined spaced apart relation thereon upon the occurrence of the switching operation in the thermostat.

16. An assembly as set forth in claim 15 wherein said magnets include a pair of opposed generally planar faces, and said magnets being arranged on said movable means so that said faces are predeterminately disposed in planes which extend generally symmetrically with respect to said mounting means, respectively.

17. An assembly as set forth in claim 15 wherein said movable means comprises a pair of generally opposed spaced apart arm portions, and a pair of means in said arm portions for receiving said magnets, respectively.

18. An assembly as set forth in claim 15 wherein said mounting means comprises a shaft.

19. An assembly as set forth in claim 15 wherein said bimetal element includes a pair of end portions secured to said mounting means and said movable means, said bimetal element having a generally spiral configuration and one of said end portions being spaced generally radially outwardly of the other of said end portions.

20. In a thermostat having a shaft rotatably mounted thereto, means secured to the shaft so as to be conjointly rotatable therewith and movable with respect thereto for sensing the temperature of a space in which the thermostat may be located, means associated with the sensing means for effecting a switching operation of the thermostat upon the temperature sensing movement of the sensing means; the improvement wherein the switching operation effecting means comprises a bracket formed of non-ferrous material including a pair of depending spaced apart arm portions, a pair of magnets mounted in said arm portion pair in generally symmetrical relation with the shaft, means for interconnecting said arm portion pair, and means associated with one of said arm portion pair for securing engagement with the temperature sensing means.

21. A thermostat as set forth in claim 5 wherein said mounting means comprises a pair of arm portions depending is spaced apart relation from said interconnecting means, said magnet means pair being mounted in said arm portions, respectively.

22. A thermostat as set forth in claim 21 wherein said arm portion pair include a pair of openings therein associated in mounting engagement with said magnet means pair, respectively.

23. A thermostat as set forth in claim 8 wherein said switching means further includes armature means associated with said third terminal and arranged for magnetic coupling relation with said magnet means pair, respectively, said armature means being operable generally when arranged in the magnetic coupling relation with one of said magnet means to effect the movement of said third terminal into engagement with one of said contacts and also being operable generally when arranged in the magnetic coupling relation with the other of said magnet means to effect the movement of said third terminal into engagement with the other of said contact means.

24. A thermostat as set forth in claim 8 wherein said switch device includes means for generally encapsulating said switching means.

25. A thermostat as set forth in claim 24 wherein parts of said terminal pair and said third terminal are exposed exteriorly of said encapsulating means, respectively.

26. A thermostat as set forth in claim 9 wherein said switching means in an at rest position thereof unaffected by the magnetic coupling relation with said magnet means pair extends generally along an imaginary radius line of said post.

27. The thermostat as set forth in claim 20 wherein a switch device is associated with the switching operation effecting means and has means operable generally for switching between a pair of switching positions with the switching means having an assembly position between the switching position pair, the improvement further comprising means for mounting the switch device on the thermostat so that the switching means in the assembly position thereof is generally coincidental with a centerline radius of the shaft.

28. A thermostat comprising a base plate having an opening therein; a shaft rotatably disposed about a centerline axis thereof and extending at least in part into said opening in said base plate; a switch device including means for switching between a pair of switching positions and having an assembly position between the switching position pair; and means for locating said switch device in a predetermined position on said base plate so that said switching means in it assembly position extends generally along a radius line emanating from the centerline axis of said shaft.

29. A thermostat as set forth in claim 28 further comprising means arranged on said shaft and associated with said switch device for effecting the switching operation of said switching means between the switching position pair thereof.

30. A thermostat as set forth in claim 29 wherein said switching operation effecting means includes a pair of spaced apart magnets arranged so as to be coupled in magnetic relation with said switching means to effect its switching operation from one of the switching positions to the other thereof, respectively.

31. A thermostat as set forth in claim 30 wherein said magnet pair include a pair of opposed faces, said magnet pair being arranged on said switching operating effecting means so that said faces are disposed in planes which extend generally symmetrically with respect to said shaft, respectively.

32. A thermostat as set forth in claim 29 wherein said switching operation effecting means includes means for sensing temperature.

33. A thermostat as set forth in claim 28 wherein said switch device further includes a pair of terminal means defining the switching position pair and arranged for engagement with said switching means, respectively.

34. A thermostat as set forth in claim 33 wherein said switch device further includes means for encapsulating at least in part said terminal means pair and said switching means.

35. In a thermostat having a base plate, an opening in the base plate having a preselected centerline axis, and a switch device including means operable generally for switching between a pair of switching positions with the switching means having an assembly position between the switching position pair; the improvement comprising means associated with the base plate for locating the switch device in a predetermined position thereon so that the switching means in its assembly position extends generally along a radius line emanting from the centerline axis of the opening in the base plate.

36. The thermostat as set forth in claim 35 further comprising means for preventing displacement of the switch device from its predetermined position.

37. The thermostat as set forth in claim 35 wherein said locating means comprises at least a pair of surfaces arranged generally symmetrically with the radius line emanating from the centerline axis of the opening in the base plate, the switch device being disposed generally in abutment with said surfaces.

38. The thermostat as set forth in claim 37 further comprising means associated with the base plate for mounting the switch device, and a hardenable material arranged between said mounting means and said switch device, said hardenable material being solidified in place therebetween so as to retain said switch device against displacement from its predetermined position on said locating means.

39. In a thermostat having a base plate, an opening in the base plate having a preselected centerline axis, a shaft rotatably mounted in the opening and having another centerline axis generally coincidental with that of the opening, a switch device including means movable for switching between a pair of switching positions and having an assembly position between the switching position pair, and means associated with the shaft and the switch device and operable generally for effecting the movement of the switching means between the switching position pair; the improvement comprising means for locating the switch device in a predetermined position with respect to the base plate so that the switching means in its assembly position extends generally along a radius line emanating from the centerline axis of the opening in the base plate, and the movement effecting means including a pair of magnet means arranged thereon in predetermined positions so as to be at least in part generally symmetrical with the switch device during the operation of the movement effecting means and adapted for magnetic coupling relation with the switching means to move it between its switching position pair upon the operation of the movement effecting means, respectively.

40. The thermostat as set forth in claim 39 wherein said magnet means pair include a pair of opposed faces disposed in planes which extend generally symmetrically with respect to the another centerline axis of the shaft.

41. The thermostat as set forth in claim 39 wherein the movement effecting means has a bimetal element comprising at least a part thereof and movable in response to temperature changes to effect at least in part the operation of the movement effecting means, respectively.

42. The thermostat as set forth in claim 39 wherein the movement effecting means comprises in part a means for carrying said magnet means pair in the predetermined positions thereof, respectively.

43. The thermostat as set forth in claim 39 wherein said locating means comprises at least a pair of surfaces predeterminably arranged on the base plate with respect to the radius line emanating from the centerline axis of the opening in the base plate.

44. The thermostat as set forth in claim 39 further comprising means for retaining the switch device against displacement from the predetermined position thereof on the base plate.

45. The thermostat as set forth in claim 39 further comprising means associated with the base plate for mounting the switch device in the predetermined position thereof, and a hardenable material solidified in place between said mounting means and the switch device so as to retain the switch device against displacement from its predetermined position.

46. A thermostat comprising a base plate; a shaft rotatably disposed about a centerline axis thereof with said base plate; means operable generally for switching between a pair of switching positions and having an assembly position between the switching position pair; means associated with said base plate adapted for locating said switching means in its assembly position so as to extend generally along a radius line emanating from the centerline axis of said shaft; and means arranged on said shaft and associated with said switching means for effecting the switch operation thereof between the switching position pair, said switch operation effecting means including a pair of magnet means adapted for magnetic coupling relation with said switching means to effect its switching operation from one of the switching positions to the other thereof, respectively.

47. A thermostat as set forth in claim 46 wherein the switch operation effecting means includes means for sensing temperature.

48. A thermostat as set forth in 46 further comprising means for encapsulating at least in part said switching means, said encapsulating means being arranged on said locating means.

49. A thermostat as set forth in claim 48 further comprising means associated with said locating means and said encapsulating means for retaining said encapsulating means against displacement from a located position with respect to said locating means so as to maintain the assembly position of said switching means generally along the radius line emanating from the centerline axis of said shaft.

50. A thermostat as set forth in claim 46 wherein said magnet means are disposed on said switch operation effecting means so that at least a portion of said magnet means is arranged generally symmetrically with respect to said shaft, respectively.

* * * * *

UNITED STATES PATENT AND TRADEMARK OFFICE

CERTIFICATE OF CORRECTION

PATENT NO. : 4,274,072

DATED : June 16, 1981

INVENTOR(S) : Ralph W. Gustafson

It is certified that error appears in the above—identified patent and that said Letters Patent is hereby corrected as shown below:

Col. 6, line 56, insert --,-- after "Minn.".
Col. 10, line 34, after "Further" insert --,--;
line 35, delete "," (first occurrence);
line 53, after "means" insert --,--.
Col. 11, line 37, delete "47" and insert --147--.
Col. 12, line 23, after "4,114,681" insert --,--.
Col. 16, line 46, after "bimetal" insert --element--.
Col. 17, line 35, delete "atrest" and insert --at-rest--;
line 38, after "sensing" insert --means--.
Col. 18, line 30, delete "is" and insert --in--.
Col. 19, line 28, delete "operating" and insert --operation--.

Signed and Sealed this

*Seventh* Day of *December 1982*

[SEAL]

*Attest:*

GERALD J. MOSSINGHOFF

*Attesting Officer*

*Commissioner of Patents and Trademarks*